US005412397A

United States Patent [19]

Kanatani et al.

[11] Patent Number: 5,412,397

[45] Date of Patent: May 2, 1995

[54] DRIVING CIRCUIT FOR A MATRIX TYPE DISPLAY DEVICE

[75] Inventors: Yoshiharu Kanatani, Nara; Hirofumi Fukuoka, Osaka; Yoshihiko Orii, Nara, all of Japan

[73] Assignee: Sharp Kabushiki Kaisha, Osaka, Japan

[21] Appl. No.: 177,202

[22] Filed: Jan. 3, 1994

Related U.S. Application Data

[63] Continuation of Ser. No. 869,900, Apr. 15, 1992, abandoned, which is a continuation of Ser. No. 417,164, Oct. 4, 1989, abandoned.

[30] Foreign Application Priority Data

Oct. 4, 1988 [JP] Japan ..... 63-250349

[51] Int. Cl.[6] ..... G09G 3/36

[52] U.S. Cl. ..... 345/99; 345/100

[58] Field of Search ..... 345/94, 95, 96, 99, 345/100, 92, 87, 103; 359/54, 55

[56] References Cited

U.S. PATENT DOCUMENTS

| | | | |
|---|---|---|---|
| 4,158,860 | 6/1979 | Irie et al. | 358/230 |
| 4,481,511 | 11/1984 | Hammura et al. | 340/799 |
| 4,602,292 | 7/1986 | Togashi et al. | 340/784 |
| 4,789,899 | 12/1988 | Takahashi et al. . | |
| 4,842,371 | 6/1989 | Yasuda et al. | 340/784 |
| 4,908,710 | 3/1990 | Wakai et al. | 340/784 |

FOREIGN PATENT DOCUMENTS

| | | |
|---|---|---|
| 552858 | 12/1984 | European Pat. Off. . |
| 0313876 | 5/1989 | European Pat. Off. . |
| 0373897 | 6/1990 | European Pat. Off. . |
| 3702335 | 1/1986 | Germany . |

*Primary Examiner*—Ulysses Weldon
*Assistant Examiner*—Xiao M. Wu
*Attorney, Agent, or Firm*—Morrison & Foerster

[57] ABSTRACT

A driving circuit for a matrix type liquid crystal display device is disclosed. The driving circuit comprises: a gate driver for, during a writing period, selectively driving a scanning line included in a group of scanning lines which correspond to the field to be scanned, and for, during an erasing period, selectively driving a scanning line included in another group of scanning lines which do not correspond to the field to be scanned; a source driver for, during said writing period of an even field, applying a signal voltage the level of which corresponds to a video signal, to the signal lines, and for, during the erasing period, applying a voltage to the signal lines to set the voltage applied to the picture elements to a level below the threshold level of the picture elements; and another source driver for, during said writing period of an odd field, applying a signal voltage the level of which corresponds to a video signal, to the signal lines, and for, during the erasing period, applying a voltage to the signal lines to set the voltage applied to the picture elements to a level below the threshold level of the picture elements. The writing period and the erasing period shares one horizontal scanning period.

7 Claims, 9 Drawing Sheets

DRIVING CIRCUIT FOR A MATRIX TYPE DISPLAY DEVICE

This application is a continuation of application Ser. No. 07/869,900, filed Apr. 15, 1992, which is a continuation of application Ser. No. 07/417,164, filed Oct. 4, 1989, both abandoned.

BACKGROUND OF THE INVENTION

1. Field of the invention

This invention relates to a driving circuit for a matrix type display device such as a matrix type liquid crystal display device.

2. Description of the prior art

Matrix type liquid crystal displays are beginning to match cathode-ray tubes in display quality as a result of a rapid advance in technology in recent years. Because of their excellent features such as thinness, light weight construction, and low power consumption, matrix type liquid crystal display devices are currently finding wide applications as display units for television receivers, visual display units for information processing apparatuses such as personal computers, and so on.

FIG. 5 shows diagrammatically one example of a conventional matrix type liquid crystal display device. In the matrix type liquid crystal display device shown in FIG. 5, thin film transistors (TFTs), which are three-terminal devices, are used as the active elements for driving picture elements. A TFT liquid crystal panel 100 comprises liquid crystal picture elements (hereinafter abbreviated as "pixels") 103 disposed in a matrix form of n rows and m columns. Each pixel 103 includes a pixel electrode 106, a counter electrode 105, and a liquid crystal layer 107 sandwiched between the two electrodes. The equivalent circuit of the pixel consists of a capacitor as shown in FIG. 5. The counter electrode 105 is usually a conductive layer disposed common to all the pixel electrodes 106. Disposed adjacent to each pixel 103 is a TFT 104, the drain electrode of which is connected to the pixel electrode 106. In the TFT liquid crystal panel 100 are disposed scanning lines 101 (the number of which is n) which are parallel to one another. To the jth scanning line 101, the gate electrodes (switching terminals) of the TFTs 104 on the jth row are connected. Signal lines 102 (the number of which is m) are disposed in such a way as to intersect perpendicularly with the scanning lines 101. To the ith signal line 102, the source electrodes (signal terminals) of the TFTs 104 on the ith column are connected.

The TFT liquid crystal panel 100 is driven by a driving circuit which includes a gate driver 200 and a source driver 300. The gate driver 200 and the source driver 300 are connected to the scanning lines 101 and the signal lines 102, respectively. A video signal is input to the source driver 300. Control signals such as scanning pulses to the gate driver 200 and sampling clock pulses to the source driver 300 are supplied from a control circuit (not shown).

FIG. 6 shows an example of display timing within one field or one frame in the matrix type liquid crystal display device of FIG. 5. The source driver 300 samples the video signal which is serially input during each horizontal scanning period initiated by a horizontal synchronizing pulse ((a) and (b) of FIG. 6). Voltages $v_s(j, i)$ $(i=1, 2, \ldots, m)$ corresponding to the amplitude of the video signal sampled during the jth horizontal scanning period jH are applied in parallel to the signal lines 102 during the (j+1)th horizontal scanning period (j+1)H ((d) of FIG. 6). On the other hand, the gate driver 200 applies a pulse to the jth scanning line during the (j+1)th horizontal scanning period (j+1)H (in FIG. 6, "$g_j$" indicates a voltage applied to the jth scanning line 101). This energizes transistors (j, i) $(i=1, 2, \ldots, m)$ which are the TFTs 104 connected to the jth scanning line 101, thereby applying the voltage $v_s(J, i)$ to the drain electrodes of the transistors (j, i). Therefore, a voltage e(j, i) applied to the pixel 103 connected to the transistor (j, i) is given as the difference between $v_s(j, i)$ and the voltage $v_c$ applied to the counter electrode 105, i.e. $v_s(j, i)-v_c$ ((h) of FIG. 6). The above described operation is hereinafter called the "writing". The writing is sequentially performed over the 1st to the nth horizontal scanning periods to complete the displaying operation for one frame or one field.

Since the pixel 103 is capacitive, the voltage written therein is held over a given period of time. The voltage applied in each field or frame has the opposite polarity from that applied in the preceding field or frame. That is, an alternating-current driving method is used in which two fields or two frames make up one complete alternating-current cycle. The use of the alternating-current driving is to prevent the pixel 103 from deteriorating due to the application of a direct current voltage.

As in a cathode-ray tube, two methods are available for displaying an image by the driving circuit on a matrix type liquid crystal display device, i.e. the interlaced scanning method and the non-interlaced scanning method.

In the non-interlaced scanning method, all the scanning lines 101 are sequentially scanned to complete one frame. In the non-interlaced scanning method, if attention is paid to a particular one of the pixels 103, writing voltage is applied to that particular pixel 103 in each frame, as shown in FIG. 7.

On the other hand, in the interlaced scanning method, one frame consists of an odd field corresponding to the odd scanning lines 101 and an even field corresponding to the even scanning lines 101, and the scanning for the odd field and that for even field are alternately performed. Interlaced scanning is used in the NTSC (National Television System Committee TV) system. As shown in FIG. 8, in the interlaced scanning method, the voltage e(2k-1, i) written into the pixels 103 of the odd columns in the odd field is held throughout the scanning period for the immediately succeeding even field ((e) of FIG. 8). Likewise, the voltage e(2k, i) written into the pixels 103 of the even columns in the even field is held throughout the scanning period for the immediately succeeding odd field ((h) of FIG. 8). Therefore, the information written in the odd field and that written in the even field are simultaneously displayed during one field period $t_v$ ($t_v$=16.7 ms in the NTSC system). This in turn causes the problem that the image quality is deteriorated when displaying a moving picture.

When an image which can be displayed as a straight line in a still picture as shown in FIG. 9(*a*) is to be displayed in a moving picture which moves in the horizontal direction at a speed faster than one pixel per $t_v/2$, the displayed images on the odd rows (scanning lines) deviate from those on the even rows ( scanning lines ) by more than one pixel as shown in FIG. 9(*b*), resulting in a distortion of the displayed image. Since the TFT liquid crystal panel 100 has a function of holding the written voltage for a relatively long period of time, flicker, which would be a problem with a cathode-ray tube, can be effectively improved. However, this function in turn emphasizes the after-image effect, and, therefore, causes detrimental effects when displaying a moving picture.

Such a problem does not occur in the non-interlaced scanning method. However, to display a video signal compatible to the interlaced scanning system as is used in the NTSC system, the matrix liquid crystal display device requires the provision of a frame memory or a field memory for storing sampled video signals. It further requires the provision of a high-speed A/D converter and a circuit for three-dimensional signal processing. Furthermore, since the number of the scanning lines to be scanned during one field in the non-interlaced scanning method is twice as many compared with that in the interlaced scanning method, the non-interlaced scanning system must be provided with a high-speed driving circuit including a source driver and gate driver, and with a liquid crystal panel which is capable of high-speed operation. Even if the non-interlaced scanning method is applied to a matrix type liquid crystal display device using existing techniques, however, both the driving circuit and the display device would be extremely expensive.

SUMMARY OF THE INVENTION

The driving circuit for a matrix type display device of this invention, which overcomes the abovediscussed and numerous other disadvantages and deficiencies of the prior art, which device comprises picture elements arranged in a matrix, switching elements connected respectively to said picture elements, scanning lines each of which is connected to a switching terminal of switching elements which are arranged in one direction, and signal lines each of which is connected to a signal terminal of switching elements which are arranged in a direction crossing said one direction, the driving circuit comprises: a first driving means for, during a writing period, selectively driving any one or more scanning line included in a group of scanning lines which correspond to the field to be scanned, and for, during an erasing period, selectively driving at least one scanning line included in another group of scanning lines which do not correspond to the field to be scanned, said writing period and said erasing period sharing one horizontal scanning period; and a second driving means for, during said writing period, applying a signal voltage the level of which corresponds to a video signal, to said signal lines, and for, during said erasing period, applying a voltage to said signal lines to set the voltage applied to said picture elements to a level below the threshold level of said picture elements.

In a preferred embodiment, the writing period precedes said erasing period in one horizontal scanning period.

In a preferred embodiment, the picture elements comprises a liquid crystal.

In a preferred embodiment, the switching elements are thin film transistors.

In a preferred embodiment, the scanning terminal is a gate of said thin film transistors, and said signal terminal a source of said thin film transistors.

Thus, the invention described herein makes possible the objectives of:

(1) providing a driving circuit for a matrix type display device which can improve the image quality of the display device;

(2) providing a driving circuit for a matrix type display device which can improve the image quality of the display device even when a moving picture is displayed; and (3) providing a driving circuit for a matrix type display device which can prevent the image quality of a moving picture from deteriorating due to the after-image effect, even when the interlaced scanning method is employed.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
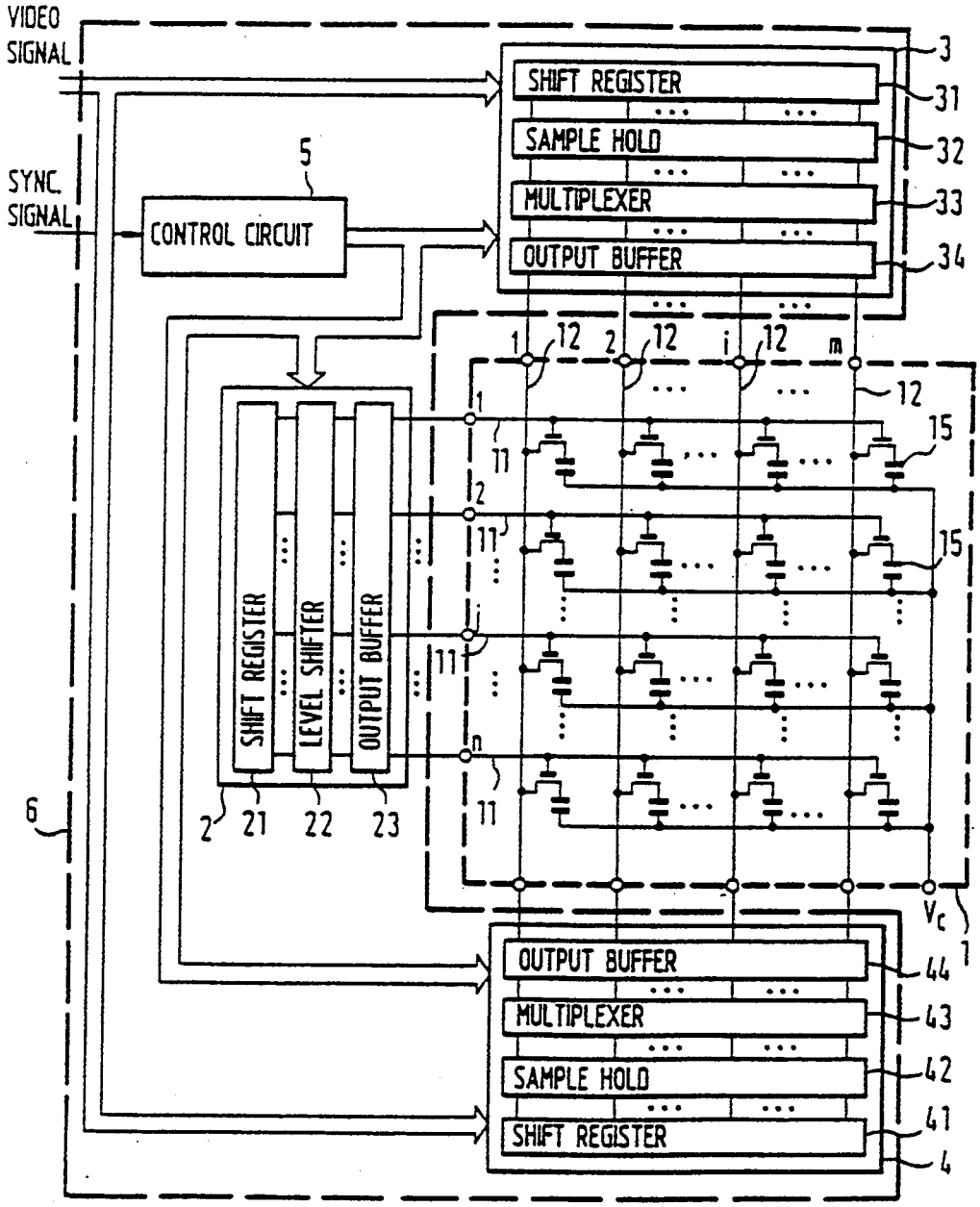
FIG. 1 is a block diagram illustrating a driving circuit according to the invention.
Figure 5:
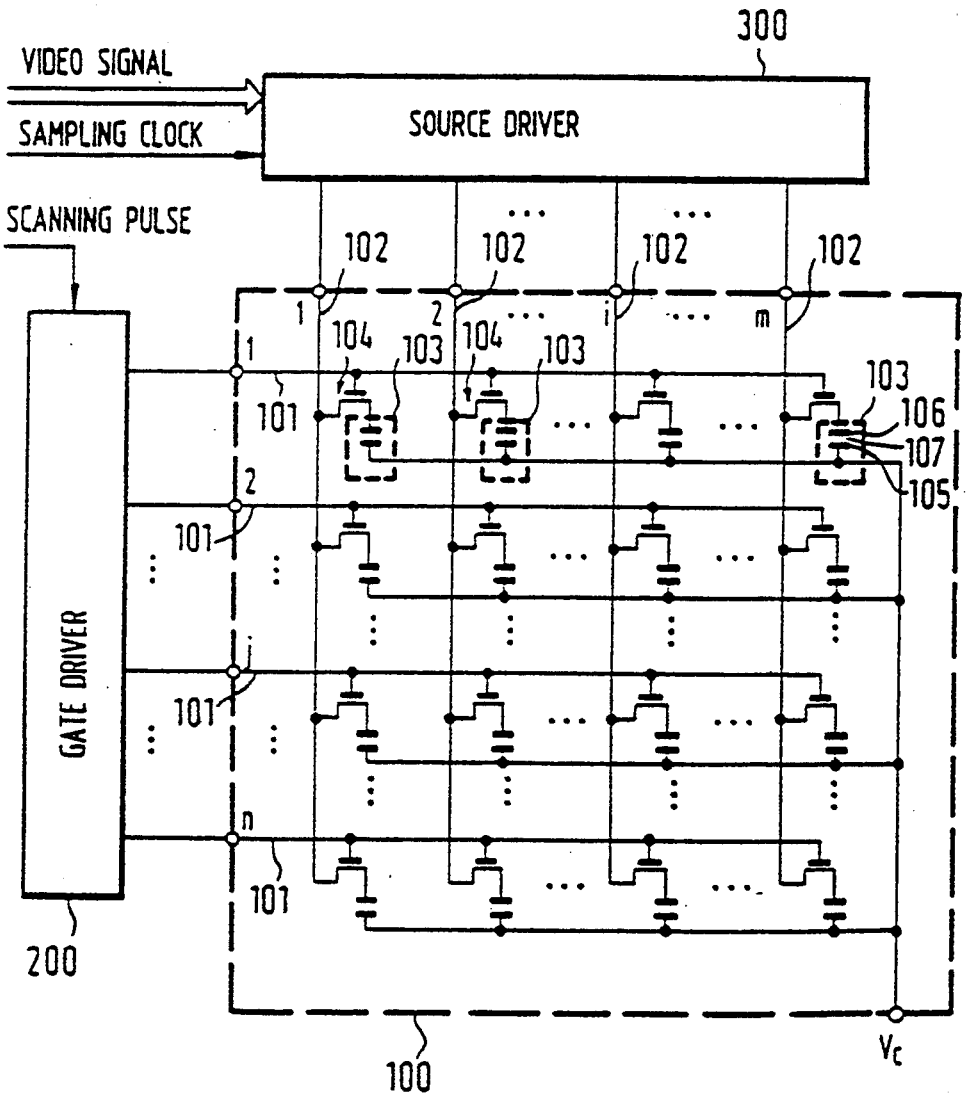
FIG. 5 PRIOR ART
FIG. 5 is a block diagram illustrating a conventional driving circuit.
Figure 6:
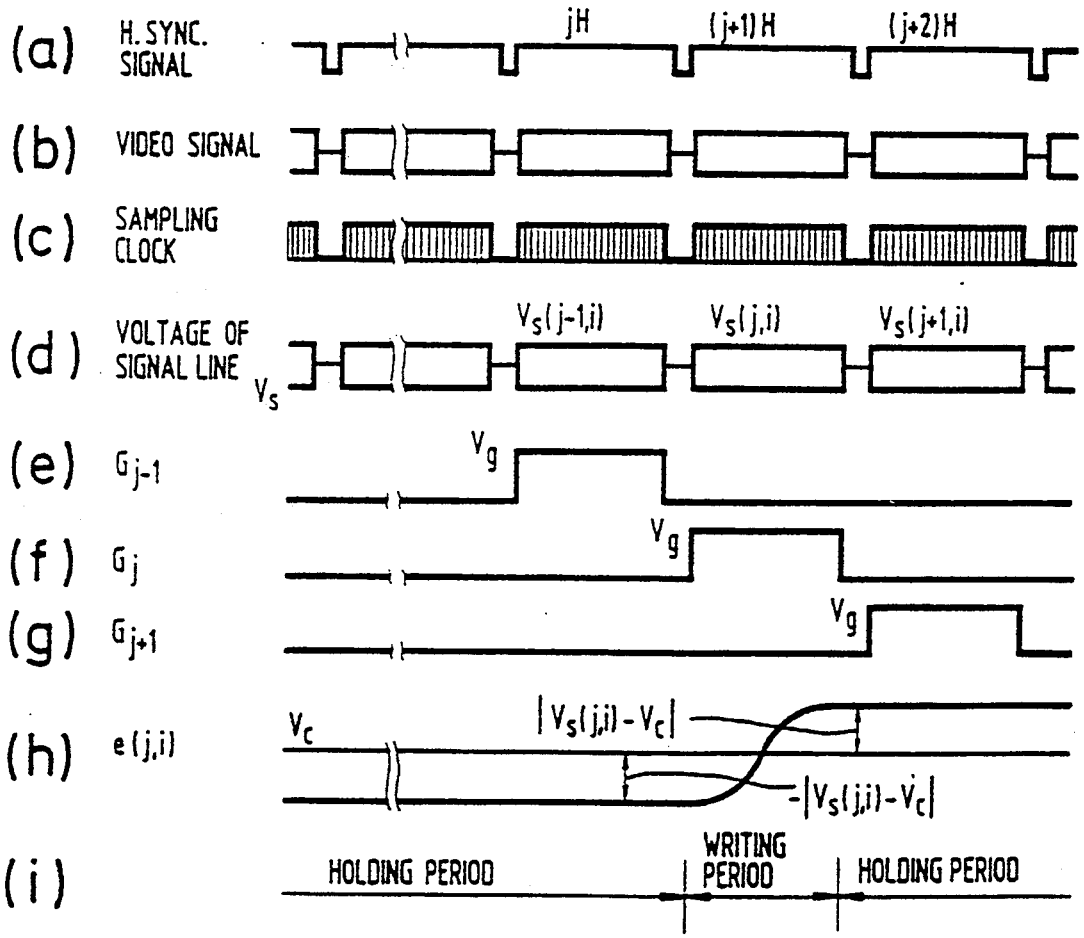
FIG. 6 PRIOR ART
FIG. 6 is a timing chart showing the display timing in one odd field in the driving circuit of FIG. 5.
Figure 7:
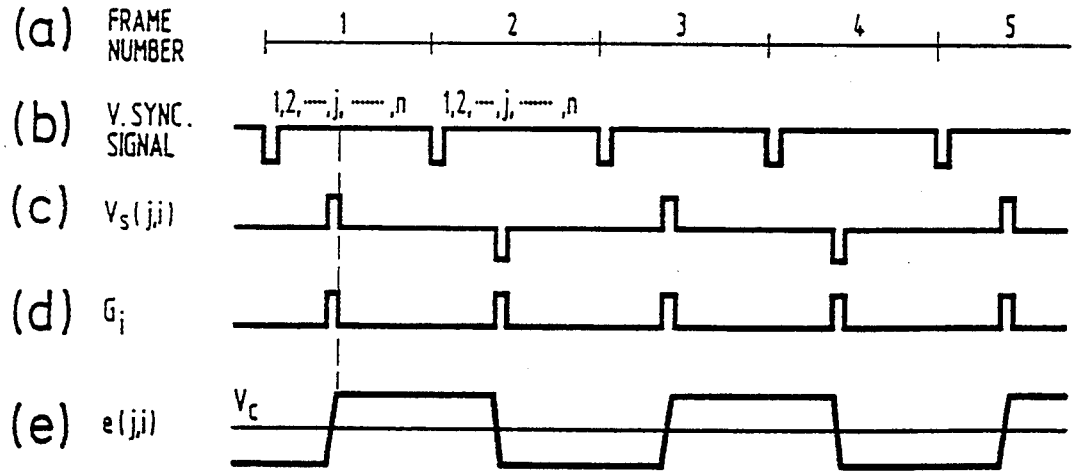
FIG.7 PRIOR ART
FIG. 7 is a timing chart showing the voltage application over a plurality of fields in the driving circuit of FIG. 5 when the non-interlaced method is employed.
Figure 8:
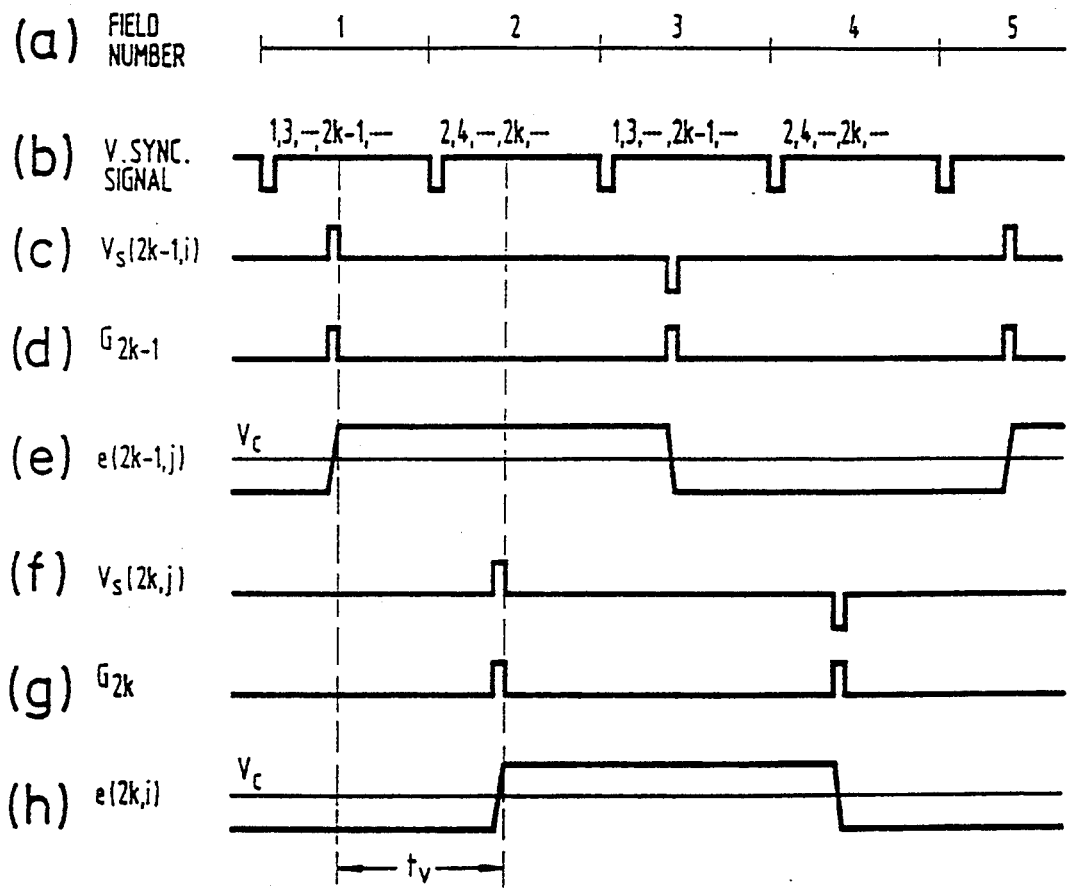
FIG. 8 PRIOR ART
FIG. 8 is a timing chart showing the voltage application over a plurality of fields in the driving circuit of FIG. 5 when the interlaced method is employed.
Figure 9:
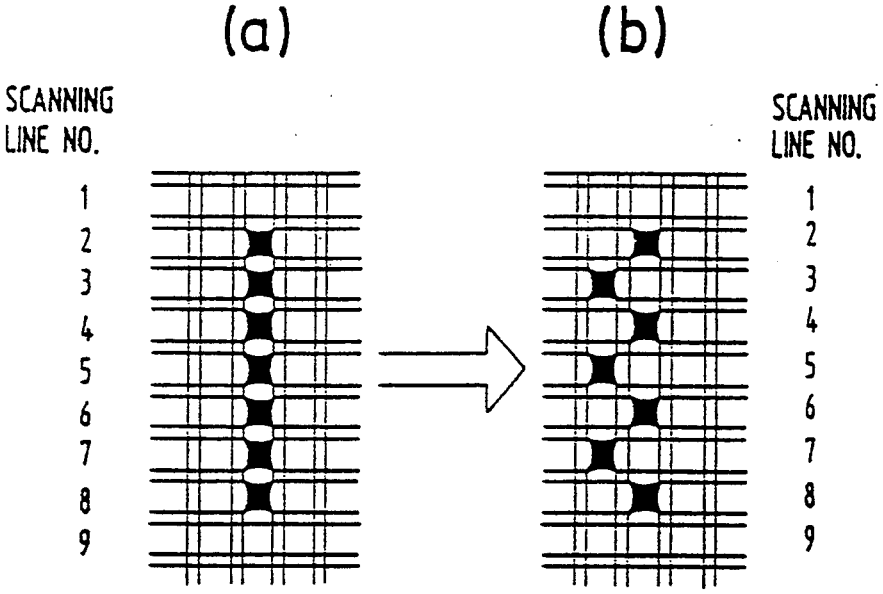
FIG. 9 PRIOR ART
FIG. 9 illustrates the still picture and moving picture in a conventional matrix type liquid crystal display device.

FIG. 1 is a block diagram of a matrix type liquid crystal display device provided with a driving circuit according to the invention. A TFT liquid crystal panel 1 has the same construction as the conventional one shown in FIG. 5. A driving circuit 6 comprises a gate driver 2, two source drivers 3 and 4, and a control circuit 5 for controlling these drivers. The control circuit 5 generates control signals in response to the synchronizing signals inputted from an external source and feeds them to the gate driver 2 and the source drivers 3 and 4. The control signals include scanning pulses supplied to the gate driver 2, and sampling clock pulses supplied to the source drivers 3 and 4. The gate driver 2 comprises a shift register 21, a level shifter 22, and an output buffer 23. The output buffer 23 is connected to scanning lines 11 of the TFT liquid crystal panel 1. The source driver 3 comprises a shift register 31, a sample hold circuit 32, a multiplexer 33, and an output buffer 34. The source driver 4 comprises a shift register 41, a sample hold circuit 42, a multiplexer 43, and an output buffer 44. Both the output buffers 34 and 44 are connected to the signal lines 12 of the TFT liquid crystal panel 1. Video signals are supplied to both the source drivers 3 and 4.

Figure 2:
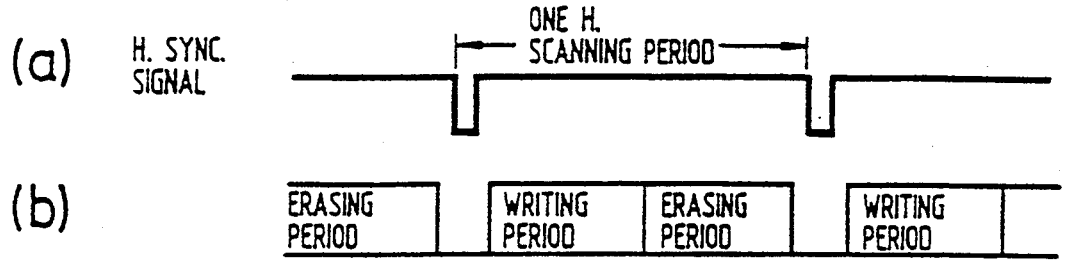
FIG. 2 illustrates schematically a writing period and an erasing period formed in one horizontal scanning period in the driving circuit of FIG. 1.

The driving circuit 6 drives the TFT liquid crystal panel 1 by using the interlaced scanning method in which the scanning is alternately performed for the odd and even fields. However, unlike a conventional system, a writing period and an erasing period are provided in each horizontal scanning period on a time-sharing basis, as shown in FIG. 2. The operation of the driving circuit 6 will be described.

Figure 3:
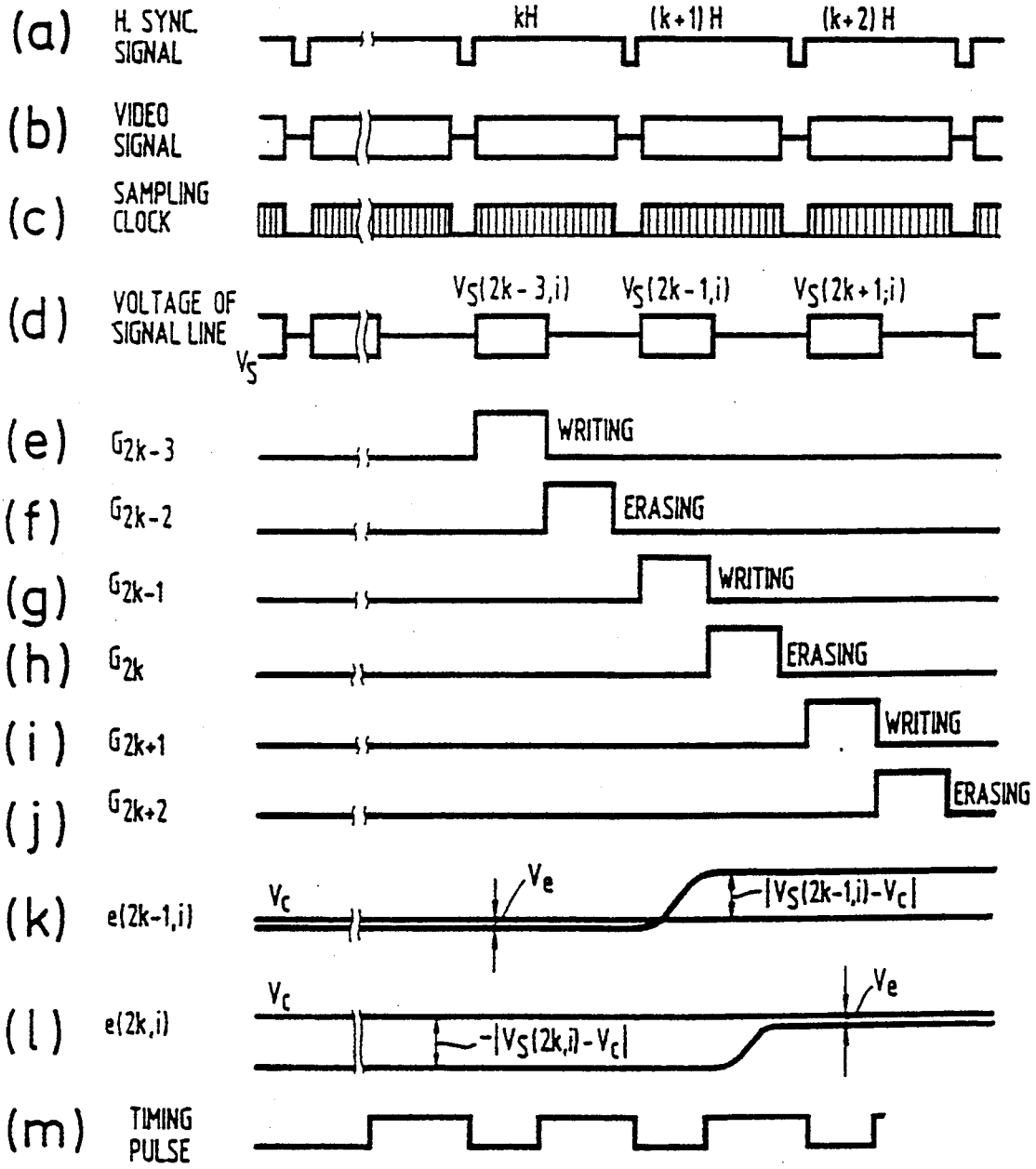
FIG. 3 is a timing chart showing the display timing in one odd field in the driving circuit of FIG. 1.

FIG. 3 shows a display timing in the case where the odd field is displayed in the matrix type liquid crystal display device of FIG. 1. During each horizontal scanning period initiated by a horizontal synchronizing pulse, the video signals serially inputted axe sampled and held by the shift register 31 and sample hold circuit 32 of the source driver 3 for the odd field. A voltage $v_s(2k\text{-}1, i)$ ($k=1, 2, \ldots, n/2$, $i=1, 2, \ldots, m$) corresponding to the amplitude of the video signal sampled and held during the kth horizontal scanning period kH is applied in parallel to the signal lines 12 via the multiplexer 33 and output buffer 34 during the writing period in the first half of the (k+1)th horizontal scanning period (k+1)H ((d) of FIG. 3). On the other hand, the gate driver 2 applies a pulse to the (2k-1)th scanning line 11 during the above writing period in the horizontal scanning period (k+1)H (in FIG. 3, "$g_{2k}$" indicates the voltage applied to the 2kth scanning line 11). This energizes transistors (2k-1, i) ($k=1, 2, \ldots, n/2$, $i=1, 2, \ldots, m$) which are the TFTs connected to the (2k-1)th scanning line 11, and the voltage $v_s(2k\text{-}1, i)$ is applied to the drain electrodes of the transistors (2k-1, i). Therefore, a voltage e(2k-1, i) applied to the pixel connected to the transistor (2k-1, i) is given as the difference between the voltage $v_s(2k\text{-}1, i)$ and a voltage vc applied to a counter electrode 15, i.e. $v_s(2k\text{-}1, i)-vc$ ((k) of FIG. 3). The writing is thus performed.

During the erasing period in the second half of the horizontal scanning period (k+1)H, the gate driver 2 applies a pulse to the 2kth scanning line adjacent to the (2k-1)th scanning line 11 chosen during the writing period in the same horizontal scanning period ((1) of FIG. 3). During the above erasing period, such a voltage as to make the voltage $v_e$ applied to the pixel below the threshold value of the pixel is applied to the signal lines 12 through the output buffer 44 of the source driver 4 for the even field. That is, a voltage close to the voltage $v_c$ applied to the counter electrode 15 is chosen for application to the signal lines 12 during the erasing period. This puts the pixels on the 2kth scanning line 11 in an erased state. This operation is hereinafter called the "erasure". The multiplexers 33 and 43 are provided to select the voltage outputted from the sample hold circuits 32 and 42 and the voltage for setting the pixels in an erased state, in accordance with the control signals supplied from the control circuit 5, to feed them to the output buffers 34 and 44, respectively. The timing pulse shown in (m) of FIG. 3 is supplied to the gate driver 2 and the source drivers 3 and 4 to control the writing period and erasing period.

The manner of time sharing one horizontal scanning period into the writing and erasing periods and their sequence may be adequately determined by considering the characteristics of the pixel and other factors.

In scanning the even field, roles are reversed between the source driver 3 for the odd field and the source driver 4 for the even field. Also, the gate driver 2 drives the even scanning lines 11 during the writing period and the odd scanning lines 11 during the erasing period.

Figure 4:
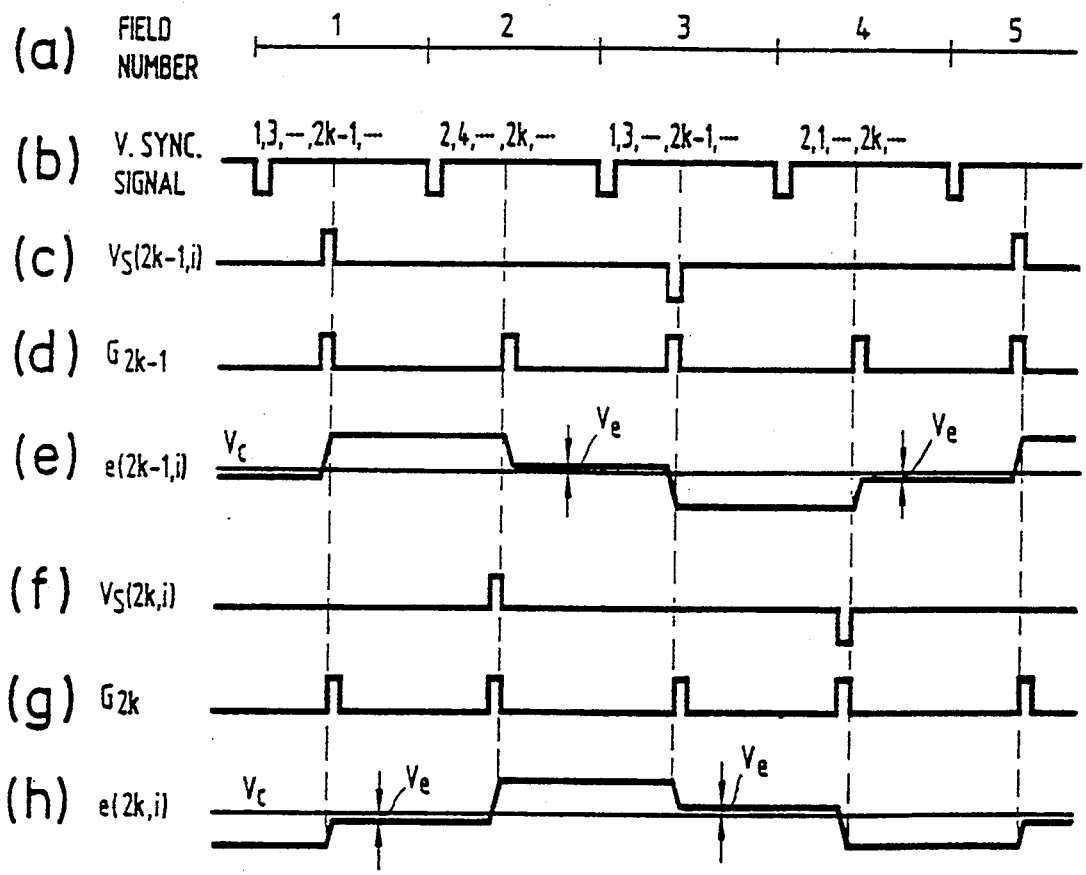
FIG. 4 is a timing chart showing the voltage application over a plurality of fields in the driving circuit of FIG. 1.

FIG. 4 illustrates the voltage application to the pixels covering a plurality of fields. For the pixels on the odd columns, the writing is performed during the scanning period for an odd field, and the erasure during the scanning period for an even field. The operation is reversed for the pixels on the even columns. Thus, the driving circuit 6 of this embodiment serves to substantially shorten the period to hold the voltage for the pixels, simultaneously, on the odd and even columns, and, therefore, helps to greatly improve the image quality even when displaying a moving picture.

Figure 10:
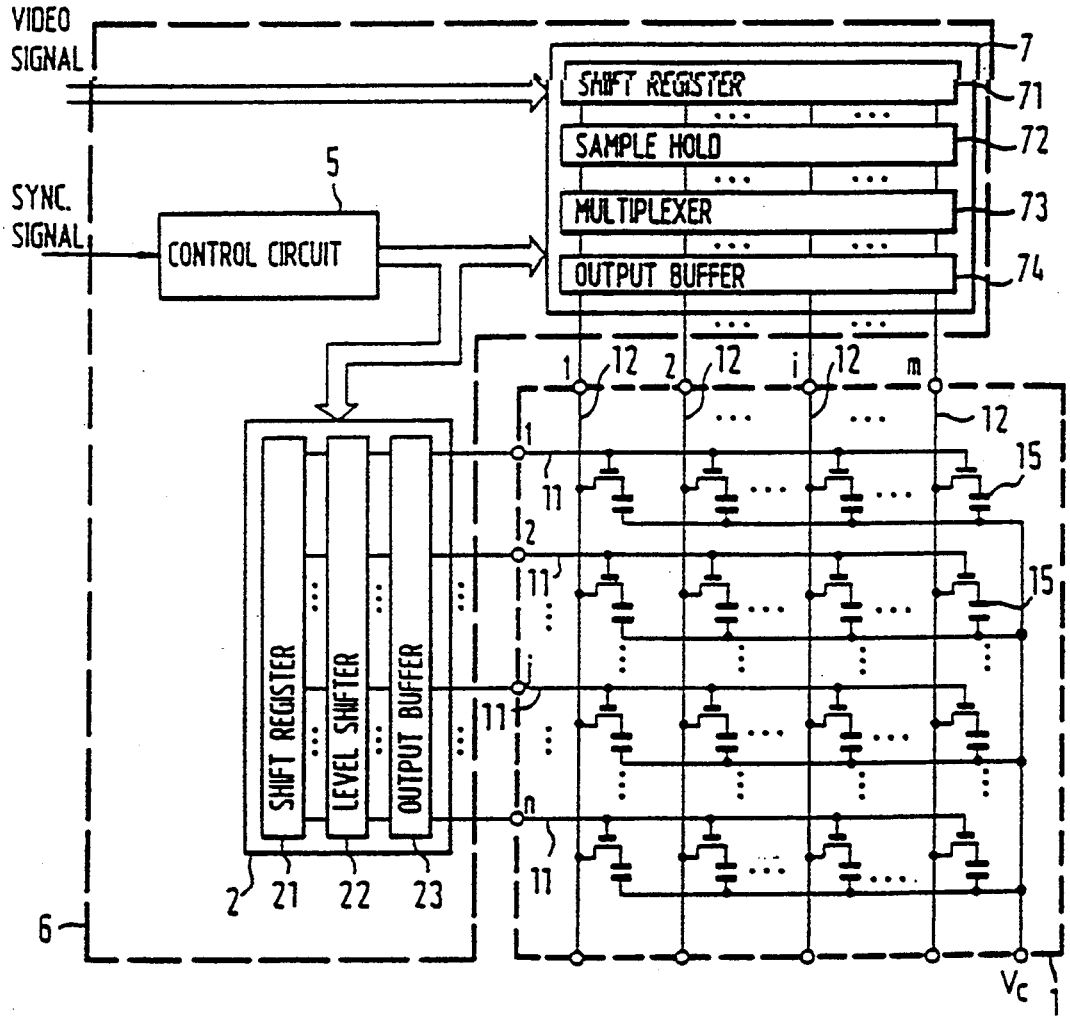
FIG. 10 is a block diagram illustrating another driving circuit according to the invention.

To facilitate the description, the driving circuit shown in FIG. 1 comprises two source drivers 3 and 4 which function in odd fields and even fields, respectively. The present invention is not restricted to the above. FIG. 10 is a block diagram of a matrix type liquid crystal display device provided with another driving circuit according to the invention. The driving circuit shown in FIG. 10 comprises a sole source driver 7. The source driver 7 comprises a shift register 71, a sample hold circuit 72, a multiplexer 73, and an output buffer 74. The source driver 7 functions as the combination of the source drivers 3 and 4 shown in FIG. 1, that is, the source driver 7 of this embodiment performs the timing control of FIG. 3 in both odd fields and even fields. The operation of the driving circuit shown in FIG. 10 will be apparent for those skilled in the art from the description of the driving circuit shown in FIG. 1, and, therefore, its detailed description is omitted.

In the invention, other switching elements such as MIM or MOS transistors may be used instead of TFTs.

The present invention is not restricted to a driving circuit for the 2:1 interlaced scanning as is used in the NTSC system.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a driving circuit for a matrix type display device which comprises picture elements arranged in a matrix suited for an interlaced scanning method, switching elements connected respectively to said picture elements, scanning lines each of which is connected to a switching terminal of said switching elements which are arranged in one direction, and signal lines each of which is connected to a signal terminal of said switching elements which are arranged in a direction crossing said one direction, said driving circuit comprises:

a first driving means for, during a writing period in a previous half of each horizontal scanning period, selecting a scanning line included in a group of said scanning lines which correspond to a field to be scanned, and for, during an erasing period in a late half of each,of the horizontal scanning periods selecting another scanning line which is adjacent to said selected scanning line and is included in another group of scanning lines which do not correspond to the field to be scanned, said writing period for said selected scanning line and said erasing period for said another scanning line sharing one horizontal scanning period respectively with a pulse in said one horizontal scanning period of each field;

a second driving means for, during said writing period in a writing field corresponding to the field to be scanned, applying to said signal lines a signal voltage above a threshold level of said picture elements determined by the liquid crystal's characteristics referenced to a voltage applied to a counter electrode, the level of said signal voltage corresponding to a video signal, and a third driving means for, during said erasing period, applying one voltage to said signal lines to set the voltage applied to said picture elements to a level below the threshold level of said picture elements referenced to a voltage applied to a counter electrode, each of said signal lines being connected to both said second driving means and said third driving means.

2. A driving circuit according to claim 1, wherein said picture elements comprises liquid crystal.

3. A driving circuit according to claim 1, wherein said switching elements are thin film transistors.

4. A driving circuit according to claim 3, wherein said switching terminal is a gate of said thin film transistors, and said signal terminal a source of said thin film transistors.

5. A driving circuit for a matrix type display device according to claim 1, wherein said scanning lines are grouped into odd lines and even lines, a signal voltage for an odd field being applied to switching elements connected to said odd scanning lines, and a signal voltage for an even field being applied to switching elements connected to said even scanning lines, and wherein said second driving means applies, to switching elements connected to said odd scanning lines through signal lines, a signal voltage for one frame which is constituted by a period for applying a voltage corresponding to said signal voltage for said odd field and another period applying a voltage having a level lower than said threshold level referenced to a voltage applied to a counter electrode for said even field, in this order; and said third driving means applies, to switching elements connected to said even scanning lines through said signal lines, a signal voltage for said frame which is constituted by a period for applying a voltage having a level lower than said threshold level for said odd field and another period for applying a voltage corresponding to said signal voltage for said even field, in this order.

6. A driving circuit for a matrix type display device according to claim 5, wherein a writing pulse is applied during said writing period in one horizontal scanning period, and an erasing pulse is applied during said erasing period in one horizontal scanning period.

7. In a driving circuit for a matrix type display device which device comprises picture elements arranged in a matrix, switching elements connected respectively to said picture elements, scanning lines each of which is connected to a switching terminal of switching elements which are arranged in one direction, and signal lines each of which is connected to a signal terminal of switching elements which are arranged in a direction crossing said one direction, said driving circuit comprises:

a first driving means for, during a writing period, selecting a scanning line included in a group of scanning lines which correspond to a field to be scanned, and for, during an erasing period, selecting another scanning line which is adjacent to said selected scanning line and is included in another group of scanning lines which do not correspond to the field to be scanned, said writing period and said erasing period sharing one horizontal scanning period and said erasing period being later than said writing period;

a second driving means for, during said writing period in said field corresponding to the field to be scanned, applying a signal voltage above a threshold level of said picture elements, the level of which corresponds to a video signal referenced to a voltage applied to a counter electrode, to said signal lines; and a third driving means for, during the erasing period which is later than said writing period by a time period substantially equal to said writing period, applying one voltage to said signal lines to set the voltage applied to said picture elements to a level below the threshold level of said picture elements referenced to a voltage applied to a counter electrode, each of said signal lines being connected to both said second driving means and said third driving means.

* * * * *